United States Patent [19]

Alberghini et al.

[11] Patent Number: 5,024,340

[45] Date of Patent: Jun. 18, 1991

[54] WIDE STANCE FOOTED BOTTLE

[75] Inventors: Alfred C. Alberghini, Dunwoody; David A. Brunson, Marietta; Stephen R. Lynn, Douglasville, all of Ga.

[73] Assignee: Sewell Plastics, Inc., Atlanta, Ga.

[21] Appl. No.: 592,778

[22] Filed: Oct. 4, 1990

Related U.S. Application Data

[63] Continuation-in-part of Ser. No. 556,174, Jul. 23, 1990, abandoned.

[51] Int. Cl.[5] ..... B65D 1/02; B65D 1/42; B65D 23/00

[52] U.S. Cl. ..... 215/1 C; 220/606; 220/608; 220/609

[58] Field of Search ..... 215/1 C; 220/604, 606, 220/608; 428/35.7, 36.92

[56] References Cited

U.S. PATENT DOCUMENTS

| | | | |
|---|---|---|---|
| 3,598,270 | 8/1971 | Adomaitis et al. | 215/1 C |
| 3,722,726 | 3/1973 | Carmichael et al. | 215/1 C |
| 3,727,783 | 4/1973 | Carmichael | 220/608 X |
| 3,881,621 | 5/1975 | Adomaitis et al. | 215/1 C |
| 3,935,955 | 2/1976 | Das | 220/608 X |
| 3,973,693 | 8/1976 | Brocklehurst | 220/606 X |
| 4,108,324 | 8/1978 | Krishnakumar et al. | 215/1 C |
| 4,247,012 | 1/1981 | Alberghini | 220/606 X |
| 4,249,666 | 2/1981 | Hubert et al. | 220/608 X |
| 4,249,667 | 2/1981 | Pocock et al. | 220/606 X |
| 4,276,987 | 7/1981 | Michel | 215/1 C |
| 4,294,366 | 10/1981 | Chang | 220/606 |
| 4,318,489 | 3/1982 | Snyder et al. | 220/606 X |
| 4,355,728 | 10/1982 | Yoshino et al. | 220/606 X |
| 4,368,825 | 1/1983 | Motill | 215/1 C |
| 4,465,199 | 8/1984 | Aoki | 220/606 X |
| 4,598,831 | 7/1986 | Nakamura et al. | 215/1 C |
| 4,785,949 | 11/1988 | Krishnakumar et al. | 215/1 C |
| 4,865,206 | 9/1989 | Behm et al. | 220/70 X |
| 4,867,323 | 9/1989 | Powers | 220/606 X |
| 4,889,752 | 12/1989 | Beck | 215/1 C X |
| 4,892,205 | 1/1990 | Powers et al. | 220/606 X |
| 4,978,015 | 12/1990 | Walker | 215/1 C |

FOREIGN PATENT DOCUMENTS

| | | | |
|---|---|---|---|
| 0199949 | 4/1989 | Japan | 215/1 C |
| 8605462 | 9/1986 | PCT Int'l Appl. | 220/606 |

*Primary Examiner*—Sue A. Weaver
*Attorney, Agent, or Firm*—Locke Reynolds

[57] ABSTRACT

A blow-molded bottle of thermoplastic resin has a hollow body with a generally cylindrical side wall rotationally symmetric about a longitudinal axis of the bottle and an integral base merging with the side wall. The base is defined by an outer surface having a plurality of arcuately extending downward projections separated from each other by hemispherical segments extending from the cylindrical side wall to the longitudinal axis of the bottle. Each of the arcuately extending downward projections has a first inclined portion contiguous to the longitudinal axis, a second inclined portion situated radially outside of, and axially displaced downwardly from, the first inclined portion, a generally perpendicular ring segment having an upper edge united with the first inclined portion by a curved portion having a radius of between about 0.015 in. and 0.060 in., and a lower edge united with the second inclined portion. A radially outwardly and upwardly curved portion defining the axially lower most extent of each downward projection has an inner edge united with the second inclined portion. An inclined outer wall portion having an upper edge united with the cylindrical side wall has a lower edge united with the radially outwardly and upwardly curved portion. Slanted radial facets merge the sides of the arcuately extending downward projections with the hemispherical segments extending from the cylindrical side wall to the longitudinal axis of the bottle.

24 Claims, 1 Drawing Sheet

WIDE STANCE FOOTED BOTTLE

CROSS-REFERENCE TO RELATED APPLICATIONS

This is a continuation-in-part of application Ser. No. 07/556,174 filed Jul. 23, 1990 now abandoned.

BACKGROUND OF THE INVENTION

This invention relates generally to plastic bottles for the retention of fluids under pressure such as carbonated beverages or the like. The invention particularly relates to an improved integral base for such bottles.

During the last twenty years or so, there has been a dramatic shift in the packaging of carbonated beverages, particularly, soft drinks, away from glass containers and toward plastic containers. The plastic containers initially took the form of a two-piece construction wherein a plastic bottle included a generally hemispherical bottom to which was applied a separate base cup which would permit the bottle to stand upright. The hemispherical bottom was seen as the most desirable shape for retaining the pressure generated by the carbonation within the beverage. The pressures can rise up to 100 p.s.i. or more when the bottled beverage is exposed to the sun, stored in a warm room, car trunk, or the like. Such plastic containers represented a significant safety advantage over glass containers when exposed to the same internal pressures. However, the two-piece construction was not viewed as optimum inasmuch as it required a post molding assembly step, and, generally, a separation step prior to reclaiming or recycling of the resins forming the bottle and base cup.

During this period of development, various attempts were made to construct a one-piece, self-supporting container which would be able to retain the carbonated beverages at the pressures involved Such a one-piece container requires the design of a base structure which would support the bottle in an upright position and would not bulge outwardly at the bottom. A variety of designs have been attempted following one of two principal lines of thought. One line of designs involved a so-called champaign base having a complete annular peripheral ring. Examples of such bottles are found in U.S. Pat. Nos. 3,722,726; 3,881,621; 4,108,324; 4,247,012; and, 4,249,666. Another variety of designs is that which includes a plurality of feet protruding downward from a curved bottom. Examples of this variety are to be found in U.S. Pat. Nos. 3,598,270; 4,294,366; 4,368,825; 4,865,206; and, 4,867,323.

Bottles using each of these general designs have, in the past, shown significant drawbacks. In order to prevent involution of the bottom of bottles using a champaign style, it was generally found necessary to incorporate a significant amount of resin in the base of the bottle thereby ensuring its stability at room temperature. This incorporation of significant amounts of resin in the base of the bottle had the effect of not only increasing the cost of the bottle, but also making it increasingly subject to drop impact failure.

Reasonably stable footed bottles could be made employing less resin, but the uneven orientation of the polymer in the footed area of the bottom often contributed to uneven post filling expansion of either one or more feet or the central portion of the bottom creating what is generally referred to as a "rocker." Further, it was recognized that the stability of the bottle was directly related to the size of the footprint of the bottle.

Whereas some of the earlier designs were in the form of a plurality of nearly point-like feet spaced apart by about half the diameter of the bottle, more recent designs have tended toward a wider spacing of the feet with each foot designed to contact an increased area of the underlying surface.

Throughout the development of various improvements on the two basic designs has been the constant goal to develop a container of stable configuration using as little resin as possible thereby reducing the cost of the container while maximizing the utility of natural resources.

SUMMARY OF THE INVENTION

A blow-molded bottle of thermoplastic resin of the present invention has a hollow body with a generally cylindrical side wall rotationally symmetric about a longitudinal axis of the bottle, and an integral base merging with the side wall. The base is defined by an outer surface comprising at a plurality of downward projections, the lower most extent of which is arcuately extending. The downward projections are separated from each other by hemispherical segments extending from the cylindrical side wall to the longitudinal axis of the bottle. Each of the downward projections has, in cross section, a first inclined portion contiguous to the longitudinal axis A second inclined portion is situated radially outside of, and axially displaced downwardly from the first inclined portion. A generally perpendicular ring segment has an upper edge united with the first inclined portion and a lower edge united with the second inclined portion. The lower most extent of each downward projection is defined by a radially outwardly and upwardly curved portion having an inner edge united with the second inclined portion and an outer edge leading to the cylindrical side wall. The pair of inclined portions coupled together by the substantially perpendicular ring segment provides significant pressure stability for the base. The wide stance and large arcuate proportion of each of the downward projections provides for significant mechanical stability for the container against tipping or toppling.

The stability of the bottom is provided in part by providing the base with a thickened resin portion extending at least from the inner margin of the first inclined portion through the lower edge of the generally perpendicular ring segment united with the second inclined portion. This thickened portion has a thickness of between about two and five times the thickness of the side wall of the bottle. Despite the presence of an enhance resin thickness in this area, bottle capacities of 0.5 liter have been achieved with about 25 grams of resin. The preferred resin employed to make the bottle is polyethylene terephthalate (PET). Other resins can be employed including other saturated polyesters, polyvinylchloride, nylon and polyproplene. The inner surface is curved along each of the hemispherical segments such that the thickness is uniformly tapered from the cylindrical side wall to a point contiguous to the longitudinal axis of the bottle.

The stability of the bottom is also provided in part by providing the base with a very small radius curved portion between the outer margin of the first inclined portion and the upper edge of the generally perpendicular ring segment. The radius of this curved portion is preferably between about 0.015 in. and 0.060 in. If this curved portion has a radius of greater than about 0.060 in., the generally perpendicular ring segment has a tendency to flatten when the bottle is filled with a carbonated liquid. If the curved portion has a radius of less than about 0.015 in., the bottle base is susceptable to stress cracking and failure at this point. It has been found that with this curved portion having a radius of about 0.030 in., the bottle is able to contain in excess of five volumes of $CO_2$ at temperatures greater than 100° F.

These and other features of the present invention, together with their inherent advantages, will become apparent to those skilled in the art upon consideration of the following detailed description of preferred embodiments exemplifying the best mode of carrying out the invention as presently perceived. The detailed description particularly refers to the accompanying drawings.

DESCRIPTION OF PREFERRED EMBODIMENTS

Figure 1:
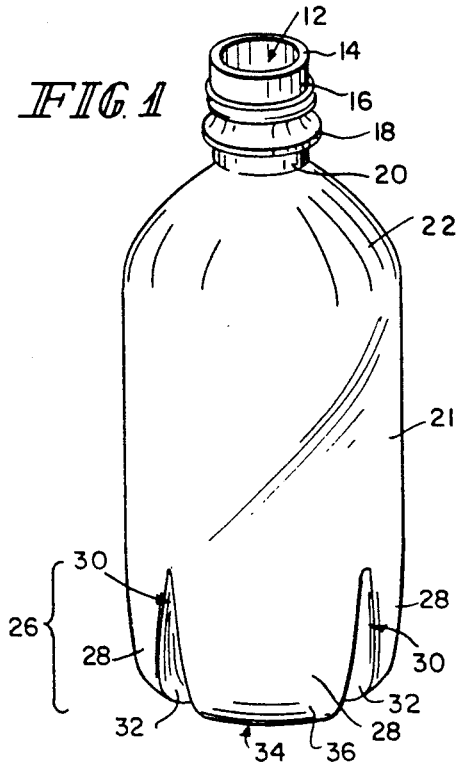
FIG. 1 is a perspective view of a bottle constructed in accordance with the present invention.

A perspective view of a bottle 10 made in accordance with the present invention appears in FIG. 1. The bottle 10 includes a mouth 12 defined by a rim 14 at the top of a finish 16 adapted, in the conventional manner, to receive a closure (not illustrated) for sealing the contents of the bottle. A support ring 18 below the finish 16 is employed during the blow-molding procedure in the usual manner. Immediately below the support ring 18 is neck 20 which flares outwardly via shoulder portion 22 to a generally cylindrical body portion 24. The bottle terminates at its lower end in a base 26 which is integrally formed with the cylindrical side wall 24. While the container 10 is shown in FIG. 1 to have a mouth 14 which is only a small fraction of the diameter of the cylindrical side wall 24, the size and appearance of that portion of the bottle above the cylindrical side wall plays no unique part in the present invention and is merely for illustrative purposes so as to show a complete bottle 10.

The base 26 includes a plurality of arcuately extending downward projections 28 which are separated from each other by hemispherical arc segments 30. The hemispherical arc segments 30 are at the intersection of slanted radial facets 32 which define the sides of each of the downward projections 28. The lower most extremities of each of the downward projections is an arcuate line segment 34 on a radially outwardly and upwardly curved outer surface 36.

Figure 2:
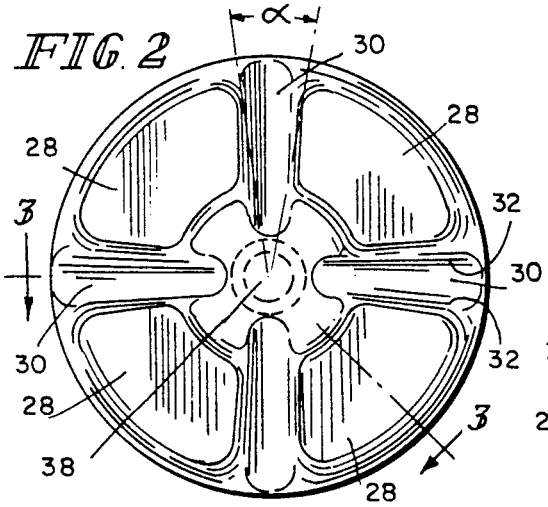
FIG. 2 is a bottom plan view of the bottle shown in FIG. 1.

A plan view of the bottom as shown in FIG. 2, reveals a central portion 38 surrounded by four arcuately extending downward projections 28 which are in turn separated from each other by four hemispherical segments 30. The slanted radial facets 32 define the sides of each of the arcuately extending downward projections 28 and merge with the hemispherical segments 30. The hemispherical segments and adjoining slanted radial facets 32 occupy an angle $\alpha$ which is shown to be about 20°. The arcuate extent of the downward projections 28 is then about 70° in the embodiment shown in FIGS. 1 and 2.

Figure 3:
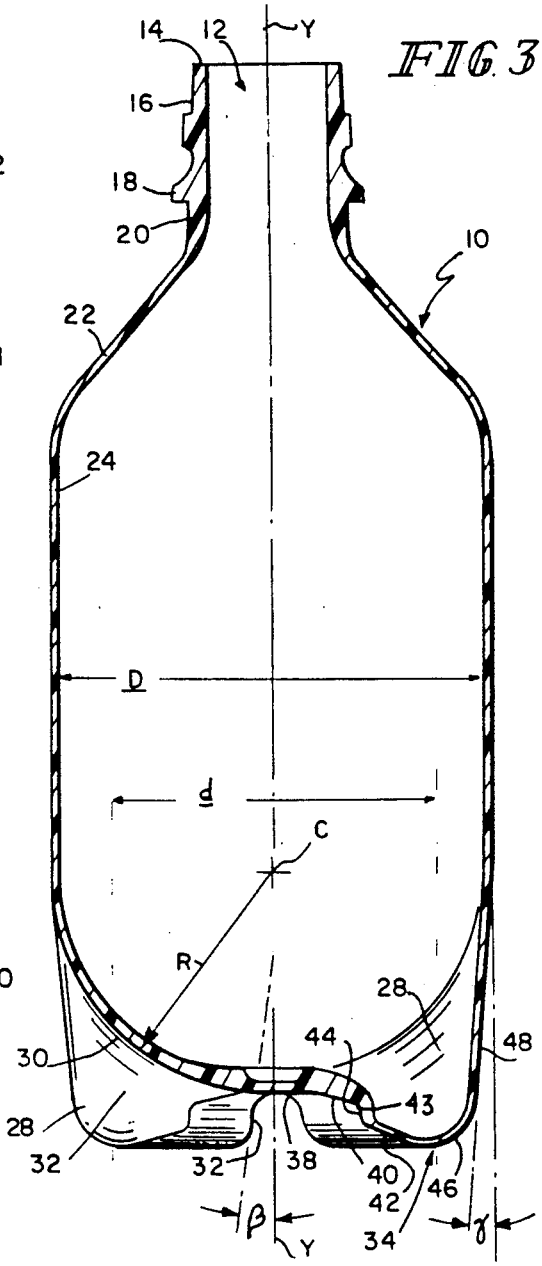
FIG. 3 is a sectional view taken along lines 3—3 of FIG. 2.

In the sectional view shown in FIG. 3, it will be seen that the cylindrical side wall 24 is generally symmetric about a longitudinal axis Y of the bottle 10. The hemispherical segment 30 can be seen to be the result of a constant radius R established from a center of curvature C located on the longitudinal axis Y. Each of the downward projections 28 includes a first inclined portion 40 and a second inclined portion 42 joined together by a substantially vertical ring segment 44. The inner margin of the first inclined portion merges with the central portion 38 contiguous to the longitudinal axis Y. The first inclined portion is shown to be radially inside and axially upwardly offset from the second inclined surface 42 by virtue of the essentially perpendicular ring segment 44.

A very small radius curved portion 43 is between the outer margin of the first inclined portion 40 and the upper edge of the generally perpendicular ring segment 44. The radius of curved portion 43 is preferably between about 0.015 in. and 0.060 in. If the curved portion 43 has a radius of greater than about 0.060 in., the generally perpendicular ring segment 44 has a tendency to flatten when the bottle 10 is filled with a carbonated liquid. If the curved portion 43 has a radius of less than about 0.015 in., the bottle base is susceptable to stress cracking and failure at this point. It has been found that with this curved portion 43 having a radius of about 0.030 in., the bottle 10 is able to contain in excess of five volumes of $CO_2$ at temperatures in excess of 100° F.

The outer margin of the second inclined portion merges with a radially outward and upwardly curved portion 46 which defines the axially lower most extent of each downward projection forming a generally circular but segmented ring 34 on which the bottle stands.

An outer wall portion 48 which is inclined at an angle $\gamma$ with respect to the cylindrical side wall 24 joins the cylindrical side wall to the curved portion 46. As shown in FIG. 3, the angle $\gamma$ is between about 1° and 10°, and preferably about 5° thereby permitting the ring 34 to have a diameter d which is approximately 0.7 times the major diameter D of the cylindrical side wall 24.

The facets 32 which define the sides of the downward projections are shown to be inclined at an angle $\beta$ with respect to a plane passing through the axis of symmetry Y. As shown in FIG. 3, the angle $\beta$ is about 10°.

Figure 4:
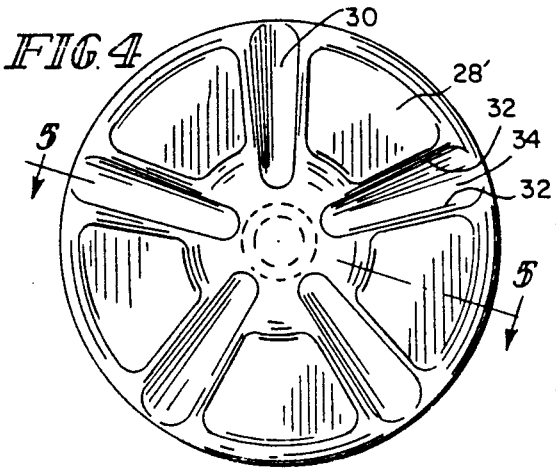
FIG. 4 is a bottom plan view of an alternative embodiment of the present invention.
Figure 5:
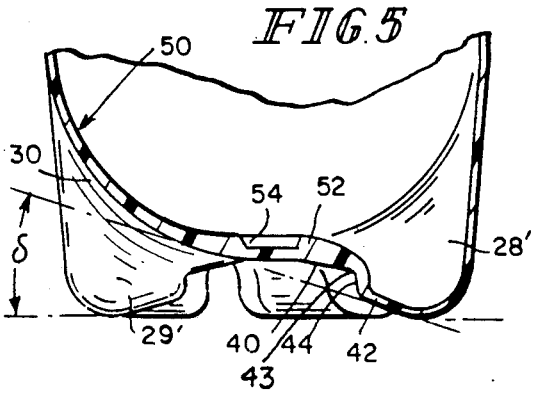
FIG. 5 is a sectional view of the lower portion of the bottle shown in FIG. 4 taken along lines 5—5.

While FIGS. 1-3 illustrate an embodiment of the bottle 10 having four downward projections 28, the number is subject to some variation. FIGS. 4 and 5 illustrate another embodiment of the container 10 having five downward projections 28'. It will be noted that the hemispherical segments 30 and adjacent slanted radial facets 32 occupy approximately the same arcuate extent as shown in FIG. 2 while the arcuate extent of each of the downward projections 28' occupies only about 55°-57°. From the sectional view in FIG. 5, it will be seen that the upper inclined portion 40 and the lower inclined portion 42 are inclined at about the same angle so as to be essentially parallel to each other and inclined at an angle $\delta$ with respect to the underlying surface. The angle $\delta$ is preferably greater than 10°, and is shown in FIG. 5 to be about 15°. It is to be additionally noted that angle $\delta$ of inclination of the lower segment 42 and the vertical extent of the perpendicular ring segment 44 is such that the lower inclined portion 42 is co-planar with a tangent to the opposite hemispherical segment 30.

The base 26 of the container 10 is further defined by an inside surface 50 which does not mirror the outside surface but rather provides for a thickened portion 52 extending from the inner margin of the first inclined portion 40 through the lower edge of the perpendicular ring segment united with the second inclined portion 42. This thickened portion has a thickness between about 2 and 5 times the thickness of the cylindrical side wall 24 and inclined outer wall portions 48. The thickened portion 52 tapers essentially uniformly along the length of the hemispherical segments 30 from a maximum thickness contiguous to the axis Y to a thickness corresponding to the cylindrical side wall 24 at the merger therewith.

The step 54 shown in the interior of the thickened portion in the area of the central region 38 is an artifact caused by the extension of the stretch rod during the blowing process into "soft contact" with the interior of the blow mold to ensure that the parison does not wander during the blowing operation. This soft contact assures the proper deposition of a lower portion of the parison as shown in FIGS. 3 and 5 so as to achieve the desired mechanical strength in the bottle while placing sufficient resin to fully develop the downward projections 28 and 28'.

In preliminary tests of bottles in accordance with the present design, 500 ml. bottles were able to be formed using less than 25 grams of PET resin. The bottles, when filled with a carbonated liquid and capped, maintained the desired configuration and in particular maintained an outer segmented ring like contact along line 34.

Although the invention has been described in detail with reference to certain preferred embodiments and specific examples, variations and modifications exist within the scope and spirit of the invention as described and as defined in the following claims.

What is claimed is:

1. A blow-molded bottle of thermoplastic resin having a hollow body with a generally cylindrical side wall rotationally symmetric about a longitudinal axis of the bottle, and an integral base merging with the side wall, the base being defined by an outer surface comprising a plurality of arcuately extending downward projections separated from each other by hemispherical segments extending from the cylindrical side wall to the longitudinal axis of the bottle, each of said arcuately extending downward projections having a first inclined portion contiguous to the longitudinal axis, a second inclined portion situated radially outside of, and axially displaced downwardly from, the first inclined portion, a generally perpendicular ring segment having an upper edge united with the first inclined portion and a lower edge united with the second inclined portion, and a radially outwardly and upwardly curved portion defining the axially lower most extent of each downward projection and having an inner edge united with the second inclined portion and an outer edge united with the cylindrical side wall.

2. The blow-molded bottle of claim 1 wherein each of said arcuately extending downward projections further includes a curved portion at the union of the generally perpendicular ring segment upper edge and the first inclined portion, the curved portion having a radius of between about 0.015, in. and 0.060 in.

3. The blow-molded bottle of claim 2 wherein each of said arcuately extending downward projections further includes an inclined outer wall portion between the cylindrical side wall and the radially outwardly and upwardly curved portion.

4. The blow-molded bottle of claim 3 wherein the inclined outer wall portion between the cylindrical side wall and the radially outwardly and upwardly curved portion is inclined with respect to the cylindrical side wall at an angle of about 1° to 10°.

5. The blow-molded bottle of claim 2 wherein said second inclined portion of each of said arcuately extending downward projections is axially displaced downwardly a sufficient distance by said generally perpendicular ring segment and is inclined at an angle such that the second inclined portion is coplanar with a line tangent to an opposite one of said hemispherical segments extending from the cylindrical side wall to the longitudinal axis of the bottle.

6. The blow-molded bottle of claim 3 wherein said second inclined portion of each of said arcuately extending downward projections is inclined at an angle of greater than 10° with respect to a plane normal to the longitudinal axis of the bottle.

7. The blow-molded bottle of claim 6 wherein said second inclined portion of each of said arcuately extending downward projections is inclined at an angle of about 15° with respect to a plane normal to the longitudinal axis of the bottle.

8. The blow-molded bottle of claim 6 wherein said first inclined portion and said second inclined portion of each of said arcuately extending downward projections are inclined at the same angle.

9. The blow-molded bottle of claim 2 wherein each of said hemispherical segments extending from the cylindrical side wall to the longitudinal axis of the bottle radiates through an arc of about 10°.

10. The blow-molded bottle of claim 2 wherein the outer surface further includes slanted radial facets merging the sides of said arcuately extending downward projections with said hemispherical segments extending from the cylindrical side wall to the longitudinal axis of the bottle.

11. The blow-molded bottle of claim 10 wherein the radial facets merging the sides of said arcuately extending downward projections with said hemispherical segments extending from the cylindrical side wall to the longitudinal axis of the bottle are slanted at an angle of about 10° from a plane passing through the longitudinal axis of the bottle.

12. The blow-molded bottle of claim 2 wherein the base is further defined by a thickened portion extending from the inner margin of the first inclined portion through the lower edge of the generally perpendicular ring segment united with the second inclined portion, the thickened portion having a thickness of between about two and five times the thickness of the side wall of the bottle.

13. A blow-molded bottle of thermoplastic resin having a hollow body with a generally cylindrical side wall rotationally symmetric about a longitudinal axis of the bottle, and an integral base merging with the side wall, the base being defined by an outer surface comprising a plurality of arcuately extending downward projections separated from each other by hemispherical segments extending from the cylindrical side wall to the longitudinal axis of the bottle, each of said arcuately extending downward projections having a first inclined portion contiguous to the longitudinal axis, a second inclined portion situated radially outside of, and axially displaced downwardly from, the . first inclined portion, a generally perpendicular ring segment having an upper edge united with the first inclined portion and a lower edge united with the second inclined portion, a first curved portion at the union of the generally perpendicular ring segment upper edge and the first inclined portion having a radius of between about 0.015 in. and 0.060 in., a radially outwardly and upwardly curved portion defining the axially lower most extent of each downward projection and having an inner edge united with the second inclined portion, an inclined outer wall portion having an upper edge united with the cylindrical side wall and a lower edge united with the radially outwardly and upwardly curved portion, and slanted radial facets merging the sides of said arcuately extending downward projections with said hemispherical segments extending from the cylindrical side wall to the longitudinal axis of the bottle.

14. The blow-molded bottle of claim 13 wherein said first inclined portion and said second inclined portion of each of said arcuately extending downward projections are inclined at about the same angle, the angle being greater than 10° with respect to a plane normal to the longitudinal axis of the bottle.

15. The blow-molded bottle of claim 14 wherein the inclined outer wall portion between the cylindrical side wall and the radially outwardly and upwardly curved portion is inclined with respect to the cylindrical side wall at an angle of about 5°, wherein each of said hemispherical segments extending from the cylindrical side wall to the longitudinal axis of the bottle radiates through an arc of about 10°, and wherein the radial facets merging the sides of said arcuately extending downward projections with said hemispherical segments extending from the cylindrical side wall to the longitudinal axis of the bottle are slanted at an angle of about 10° from a plane passing through the longitudinal axis of the bottle.

16. The blow-molded bottle of claim 15 wherein the base is further defined by a thickened portion extending from the inner margin of the first inclined portion through the lower edge of the generally perpendicular ring segment united with the second inclined portion, the thickened portion having a thickness of between about two and five times the thickness of the side wall of the bottle.

17. A blow-molded bottle of thermoplastic resin having a hollow body with a generally cylindrical side wall rotationally symmetric about a longitudinal axis of the bottle, and an integral base merging with the side wall, the base being defined by an inner surface and an outer surface, the outer surface comprising a plurality of arcuately extending downward projections separated from each other by hemispherical segments extending from the cylindrical side wall to the longitudinal axis of the bottle, each of said arcuately extending downward projections having a first inclined portion contiguous to the longitudinal axis, a second inclined portion situated radially outside of, and axially displaced downwardly from, the first inclined portion, a generally perpendicular ring segment having an upper edge united with the first inclined portion and a lower edge united with the second inclined portion, and a radially outwardly and upwardly curved portion defining the axially lower most extent of each downward projection and having an inner edge united with the second inclined portion and an outer edge united with the cylindrical side wall, the inner surface being spaced from the outer surface by a distance sufficient to permit a thickened portion extending from the inner margin of the first inclined portion through the lower edge of the generally perpendicular ring segment united with the second inclined portion, the thickened portion having a thickness of between about two and five times the thickness of the side wall of the bottle.

18. The blow-molded bottle of claim 17 wherein each of said arcuately extending downward projections further includes a curved portion at the union of the generally perpendicular ring segment upper edge and the first inclined portion, the curved portion having a radius of between about 0.015 in. and 0.060 in.

19. The blow-molded bottle of claim 18 wherein each of said arcuately extending downward projections of the outer surface further includes an inclined outer wall portion between the cylindrical side wall and the radially outwardly and upwardly curved portion, and wherein the inner surface is spaced substantially uniformly from the outer wall from the union between the second inclined portion and the radially outwardly and upwardly curved portion defining the axially lower most extent of each downward projection upwardly to the union with the cylindrical side wall.

20. The blow-molded bottle of claim 18 wherein the inner surface is substantially uniformly tapered from the outer surface over the length of the hemispherical segments extending from the cylindrical side wall to a point contiguous to the longitudinal axis of the bottle.

21. A blow-molded bottle of thermoplastic resin having a hollow body with a generally cylindrical side wall rotationally symmetric about a longitudinal axis of the bottle, and an integral base merging with the side wall, the base being defined by an outer surface comprising a first inclined portion contiguous to the longitudinal axis, a second inclined portion situated radially outside of, and axially displaced downwardly from, the first inclined portion, a generally perpendicular ring portion having an upper edge united with the first inclined portion and a lower edge united with the second inclined portion, a first curved portion at the union of the generally perpendicular ring segment upper edge and the first inclined portion having a radius of between about 0.015 in. and 0.060 in., a radially outwardly and upwardly curved portion defining the axially lower most extent of the base and having an inner edge united with the second inclined portion, and an inclined outer wall portion having an upper edge united with the cylindrical side wall and a lower edge united with the radially outwardly and upwardly curved portion, the outer surface being divided by a plurality of hemispherical segments extending from the cylindrical side wall to the longitudinal axis of the bottle into a plurality of arcuately extending downward projections separated from each other by slanted radial facets merging the sides of said arcuately extending downward projections with said hemispherical segments extending from the cylindrical side wall to the longitudinal axis of the bottle.

22. The blow-molded bottle of claim 21 wherein said second inclined portion is axially displaced downwardly a sufficient distance by said generally perpendicular ring portion and is inclined at an angle such that the second inclined portion is coplanar with a line tangent to an opposite one of said hemispherical segments extending from the cylindrical side wall to the longitudinal axis of the bottle.

23. The blow-molded bottle of claim 21 wherein the base further comprises an inner surface defining a thickened portion extending from the inner margin of the first inclined portion through the lower edge of the generally perpendicular ring portion united with the second inclined portion, the thickened portion having a thickness of between about two and five times the thickness of the side wall of the bottle.

24. The blow-molded bottle of claim 22 wherein the inner surface is substantially uniformly tapered from the outer surface over the length of the hemispherical segments extending from the cylindrical side wall to a point contiguous to the longitudinal axis of the bottle.

* * * * *